US007162166B2

(12) United States Patent
Byun

(10) Patent No.: US 7,162,166 B2
(45) Date of Patent: Jan. 9, 2007

(54) IMAGE-FORMING APPARATUS HAVING AN AUTOMATIC SELF-TEST REPORTING FUNCTION AND METHOD THEREOF

(75) Inventor: Hyung-sik Byun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/125,153

(22) Filed: May 10, 2005

(65) Prior Publication Data

US 2005/0265734 A1 Dec. 1, 2005

(30) Foreign Application Priority Data

May 25, 2004 (KR) ..... 10-2004-0037367

(51) Int. Cl.
*G03G 15/00* (2006.01)

(52) U.S. Cl. ..... 399/9; 399/10; 399/37

(58) Field of Classification Search ..... 399/9, 399/10, 11, 12, 13, 37
See application file for complete search history.

(56) References Cited

U.S. PATENT DOCUMENTS 5,978,619 A * 11/1999 Kato et al. ..... 399/80
6,318,833 B1 11/2001 Lyman et al.
2005/0105928 A1* 5/2005 Nakazato et al. ..... 399/49

FOREIGN PATENT DOCUMENTS

| | | |
|---|---|---|
| JP | 08-292897 | 11/1996 |
| JP | 11-110166 | 4/1999 |
| KR | 1994-3747 | 3/1994 |
| KR | 2000-25197 | 5/2000 |

OTHER PUBLICATIONS

Korean Office Action dated Dec. 16, 2005 issued in KR 2004-37367.

* cited by examiner

*Primary Examiner*—Hoang Ngo
(74) *Attorney, Agent, or Firm*—Stanzione & Kim, LLP

(57) ABSTRACT

An image-forming apparatus having an automatic self-test reporting function and a method thereof. The image-forming apparatus has a function of preparing and printing a separate result report as to a result of the self test performed at the time when the image-forming apparatus is powered on for the first time. Thus, the image-forming apparatus purchased by a user can notify the user whether errors exist, counter-measures to the errors, and initial setting options of the image-forming apparatus at the same time when the image-forming apparatus is powered on for the first time, enabling the user to be able to rely on the image-forming apparatus. Further, extra manipulations by a user to obtain the initial setting options of the image-forming apparatus are not required.

20 Claims, 4 Drawing Sheets

FIG. 3

THANKS FOR YOUR PURCHASE OF XXX COMBINATION OFFICE MACHINE.
IT IS NOTIFIED AS A RESULT OF THE SELF TEST THAT THE XXX
MACHINE OPERATES NORMAL. IF ANY PROBLEM OCCURS,
PLEASE CONTACT US AT SERVICE NUMBER 000 - 0000. ~302

[ SELF-TEST RESUL ]
- ROM TEST : OK
- RAM Test : OK
- MEMORY TEST : OK
- CCD LAMP TEST : WARNING (SHADING NEEDED. TO DO THE SHADING..)
- MODEM TEST : OK
- SCAN MOTOR TEST : OK
- FAN TEST : OK
- FUSER TEST : OK
- MEMORY CLEAR : OK
- HDD TEST : OK
- PRINTER ENGINE TEST : OK

~304

[SYSTEM INFORMATION OF XXX MACHINE]
- SERIAL NUMBER : SS001-02002-332
- ROM VERSION : V1.2
- PRINTER ENGINE VERSION : V2.0
- NPC VERSION : V3.0
- DRAM SIZE : 16M
- HDD SUPPORT : SUPPORTED
- TOTAL PAGE COUNT : 1
- TONER/CARTRIDGE : FULL(99%)

~306

[CURRENT SETTINGS OF XXX MACHINE]

| OPTIONS | ITEMS | CURRENT SETTING |
|---|---|---|
| COUNTRY | [USA/UK/...] | UK |
| DATE/TIME FORMAT | [USA/EUROPE] | EUROPE |
| PAPER SIZE | [A4/LETTER] | A4 |
| MODEM SPEED | [14.4/12/9.6/2.4K] | 14.4 KBps |
| EMULATION | [PCL5/PCL6/PS/KS] | PCL5 |
| RING COUNT | [2-5] | 3 |
| REDIAL COUNT | [3-7] | 3 |
| KEY SOUND | [ON/OFF] | ON |
| COPY DENSITY | [LOW/MID/HIGH] | MID |
| RECEIVE MOD | [FAX/TEL/ANSFAX] | ANSFAX |

~308

IMAGE-FORMING APPARATUS HAVING AN AUTOMATIC SELF-TEST REPORTING FUNCTION AND METHOD THEREOF

CROSS-REFERENCE TO RELATED APPLICATIONS

This application claims benefit under 35 U.S.C. § 119 from Korean Patent Application No. 2004-37367, filed on May 25, 2004, the entire content of which is incorporated herein by reference in its entirety.

BACKGROUND OF THE INVENTION

1. Field of the Invention

The present general inventive concept relates to an image-forming apparatus, and more particularly to an image-forming apparatus having an automatic self-test reporting function to test itself and print a test result when turned on for the first time.

2. Description of the Related Art

In general, a conventional image-forming apparatus first tests itself when electric power is applied and the image-forming apparatus is turned on, which is referred to as the "self-test."

Generally, the conventional image-forming apparatus starts testing itself by performing a Power On Self Test (POST) according to a system program stored in the ROM.

In the testing process, the image-forming apparatus tests various devices provided therein, such as ROMs, RAMs, the printer engine, the hard disk, the communication ports, the communication devices such as modems and the like, the scan motor, and so on. Such a test is to verify whether essential internal devices for normal operations exist in place as well as whether functional problems exist therein.

When the self test is completed, the image-forming apparatus operates its own functions by reading out its operating system. Depending on the image-forming apparatus, the POST process can be omitted.

FIG. 1 is a flow chart showing a self-test process of a conventional image-forming apparatus. Description will be made on the self-test process of the conventional image-forming apparatus with reference to FIG. 1.

When the image-forming apparatus is powered on (operation S102), the image-forming apparatus performs the self test (operation S104).

The image-forming apparatus decides whether error information exists on the result of the self test (operation S106), and, if there exists error information, the image-forming apparatus displays the error information to a user (operation S108).

If the error information does not exist as a result of the test according to the decision of the operation S106, the image-forming apparatus performs its own operations by reading the operation system, as state above. However, the self test of FIG. 1 is performed every time the conventional image-forming apparatus is powered on, and the same self test is applied even when a user purchases and powers on the image-forming apparatus for the first time.

The problem with this process is that the conventional image-forming apparatus performs the same self test and displays only short messages on a display panel, such as an LCD or the like, even when there exist errors as a result of the self test, in the case when a user purchases and powers on the image-forming apparatus for the first time. Therefore, a user can hardly recognize correct information about the errors so that the user must undergo difficulties in solving the errors. Further, since no "normal" state is instructed or displayed when there exists no errors or malfunctions, there is no way for the user to be sure that the product purchased by the user operates correctly. Further, the user having purchased the image-forming apparatus must print a report through extra manipulations in order to obtain its initial settings. Further, it is impossible for the user to have reliability of the conventional image-forming apparatus until the image-forming apparatus is connected to a host and a driver installed therein.

SUMMARY OF THE INVENTION

The present general inventive concept provides an image-forming apparatus having an automatic self-test reporting function and a method thereof enabling a self-test result to be printed on an image recording medium, such as a sheet of paper in case that a user purchases and powers on the image-forming apparatus for the first time.

Additional aspects and advantages of the present general inventive concept will be set forth in part in the description which follows and, in part, will be obvious from the description, or may be learned by practice of the general inventive concept.

The foregoing and other aspects and advantages are substantially realized by providing an image-forming apparatus having an automatic self-test reporting function, comprising a memory to store reference information on whether power is applied for the first time; a self-test unit to perform a self test when powered on; a control unit to compare a result of the self test to the stored reference information to decide whether the power is applied for the first time, and to cause a result report to be produced according to the result of the self test if the power is applied for the first time; and a print unit to print the result report.

The reference information may be in a form of a flag, and may indicate the first power-on if the reference information is set, and is cleared after the first reference by the control unit to the reference information.

The result report may include at least one item of errors which has occurred as a result of the self test, countermeasure to information on the errors, system information and setting options of the image-forming apparatus.

The image-forming apparatus may further comprise a display unit to display information requesting the user to supply paper to print in a form that a user can recognize, if there is no paper to print the result report.

The foregoing and other aspects and advantages can also be substantially realized by providing an automatic self-test reporting method of an image-forming apparatus, comprising storing reference information on whether electric power is applied thereto for the first time; performing a self test when powered on and storing a result of the self test; reading out the reference information and, if determined to be power-on for the first time, preparing a result report according to the result of the self test; and printing images on an image recording medium corresponding to the result report.

The reference information may be in a form of a flag, may indicate the first power-on if the reference information is set, and is cleared after the first reference to the reference information.

The result report may include at least one item of errors which has occurred in the result of the self test, countermeasures to information on the errors, system information and setting options of the image-forming apparatus.

The printing operation may display information requesting a user to supply recording media, such as paper to print thereon, if there is no recording media to print the result report.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 3 is a view illustrating a result report according to an embodiment of the present general inventive concept;

FIG. 4 and FIG. 6 are flow charts illustrating automatic self-test reporting operations of the image-forming apparatus of FIG. 2, according to another embodiment of the present invention.

DETAILED DESCRIPTION OF THE PREFERRED EMBODIMENTS

Figure 1:
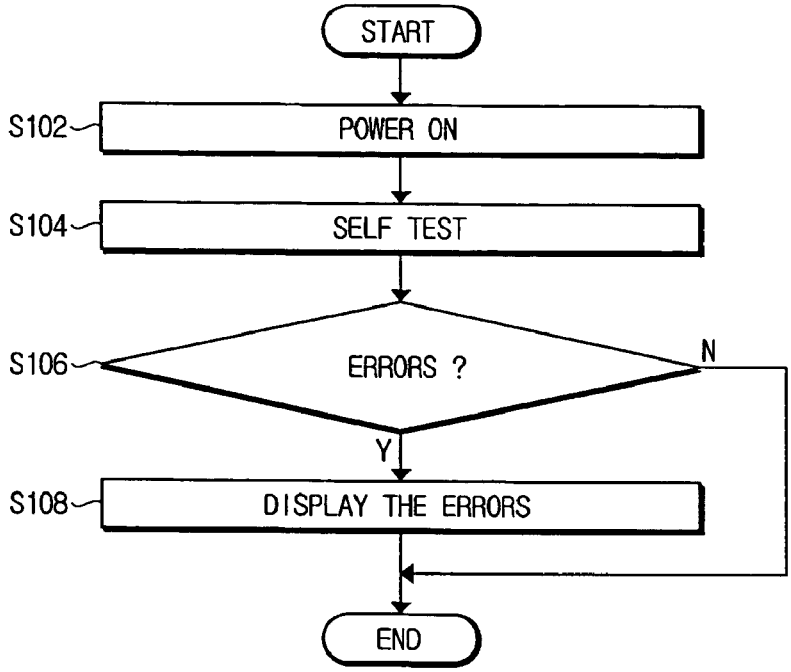
FIG. 1 (PRIOR ART)
FIG. 1 is a flow chart showing a self-test process for a conventional image-forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
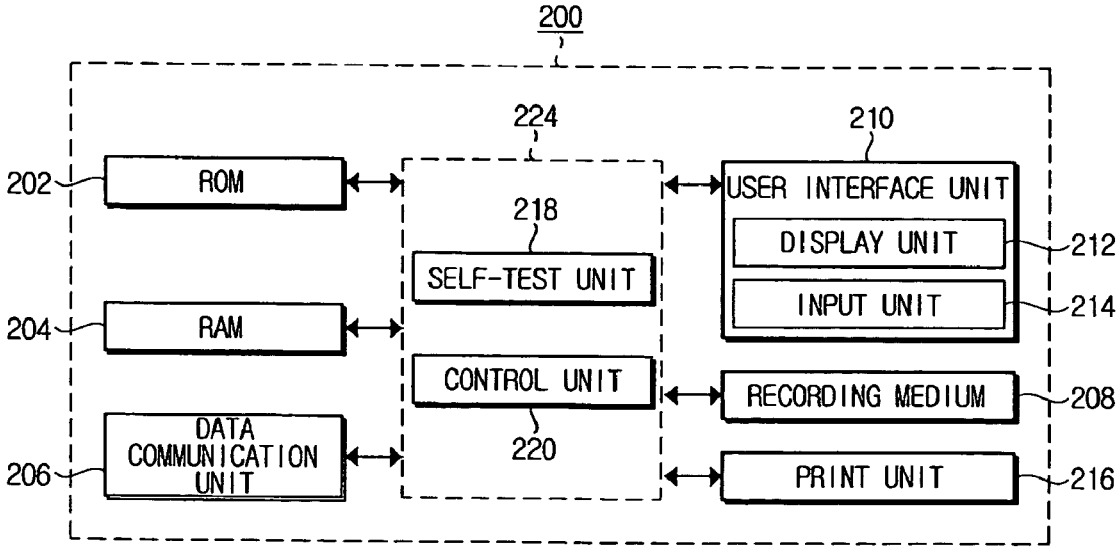
FIG. 2 is a block diagram showing an image-forming apparatus having automatic self-test reporting operations, according to an embodiment of the present general inventive concept.

FIG. 2 is a block diagram illustrating an image-forming apparatus having an automatic self-test reporting function according to an embodiment of the present general inventive concept.

The image-forming apparatus according to FIG. 2 is a device capable of printing images corresponding to image data, such as a printer for computers, photocopier, facsimile machine, combination office machine, and so on. In FIG. 2, the image-forming apparatus 200 has a ROM 202, a RAM 204, a data communication unit 206, a recording medium 208, a user interface unit 210, a print unit 216, and central processing unit (CPU) 224.

The ROM 202 can be a nonvolatile memory device, including a program ROM, a font ROM, and an EEPROM (Electrical Erasable Programmable Read-Only Memory). The ROM 202 stores the system program and font for the image-forming apparatus 200. Further, the ROM 202 stores setting options of the image-forming apparatus 200 and information on whether the image-forming apparatus 200 is powered on for the first time. Hereinafter, such reference information on whether to power on the image-forming apparatus 200 for the first time is referred to as OutofBox information.

The OutofBox information can be a flag information and at least one bit can be used for the flag. The OutofBox flag is set when the image-forming apparatus 200 is manufactured, and, if cleared, the OutofBox flag is not set again.

The RAM 204 stores image data to be processed by the control unit 220. Further, the RAM 204 can store information to be processed by the self-test unit 218.

The data communication unit 206 is a device communicating data with a host (not shown) and the like that produce and transfer image data to the image-forming apparatus 200. The data communication unit 206 may be a parallel port, a serial port, a network port, and so on, and may be a network device such as a modem, a LAN card, or the like.

The recording medium 208 is a device that stores spooled image data received through the host (not shown) and so on, such as memory devices, hard discs, floppy discs, and so on. The hard discs can be used as the recording medium 208.

The user interface unit 210 can include an input unit 214 and a display unit 212.

The input unit 214 inputs user's commands or system setting options.

The display unit 212 is a display device that displays characters or graphics that enable a user to recognize the information received from the self-test unit 218. The display unit 212 can be a display device such as a Liquid Crystal Display (LCD) or the like capable of displaying characters or graphics.

The print unit 216 prints report or images corresponding to image data received from the control unit 220.

The central processing unit 224 includes the self-test unit 218 and the control unit 220.

The central processing unit 224 controls the overall image-forming process of the image-forming apparatus 200 according to an embodiment of the present general inventive concept. The central processing unit 224 performs the self test when the image-forming apparatus 200 is powered on, converts image data into a format available to the print unit 216 dealing with the data, and sends the converted data to the print unit 216.

The self-test unit 218 performs the self test when power is supplied to the image-forming apparatus 200. The self-test unit 218 decides whether errors exist with respect to the tested devices during the self test. The results of the self test are stored in the RAM 204.

The control unit 220 reads out the OutofBox flag stored in the ROM 202, and then checks whether the flag is set, when the self-test unit 218 completes the self test. The control unit 220 prepares a result report based on the self-test result if the OutofBox flag is set. The control unit 220 refers to and then clears the OutofBox flag.

FIG. 3 is a view illustrating a result report according to an embodiment of the present general inventive concept. In FIG. 3, the result report can include a manufacturer's comments 302, countermeasures to the self-test results and errors 304, system information 306 of the image-forming apparatus 200, and user's setting options 308. Such additional information is stored in the ROM 202. The result reports do not have to include error information, and can be prepared during the normal operations of each and every device of the image-forming apparatus 200. The reference number 304 of FIG. 3 has the "WARNING" representation, indicating that an error has occurred in testing the CCD Lamp of the tested devices, and has a countermeasure to the error that is added next to the "WARNING" representation.

The control unit 220 stores the prepared result report in the RAM 204, converts the report into a format in which the print unit 216 can print on paper or other recording medium, and delivers the converted report to the print unit 216.

Further, the control unit 220 controls the overall image-forming process of the image-forming apparatus 200.

The print unit 216 prints an image corresponding to the image data delivered from the control unit 220. Further, the print unit 216 prints images corresponding to the result report delivered from the control unit 220.

Figure 4:
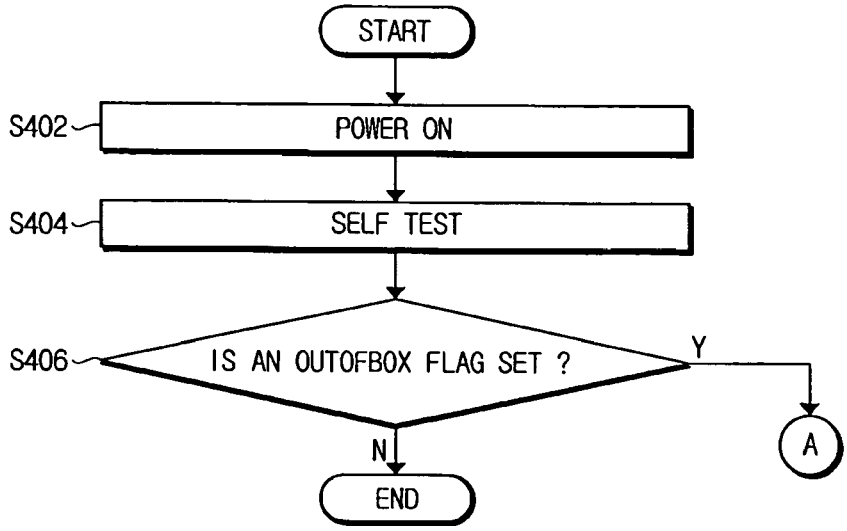
FIG. 4 and FIG. 5 are flow charts illustrating automatic self-test reporting operations of the image-forming apparatus of FIG. 2 according to an embodiment of the present general inventive concept.
Figure 5:
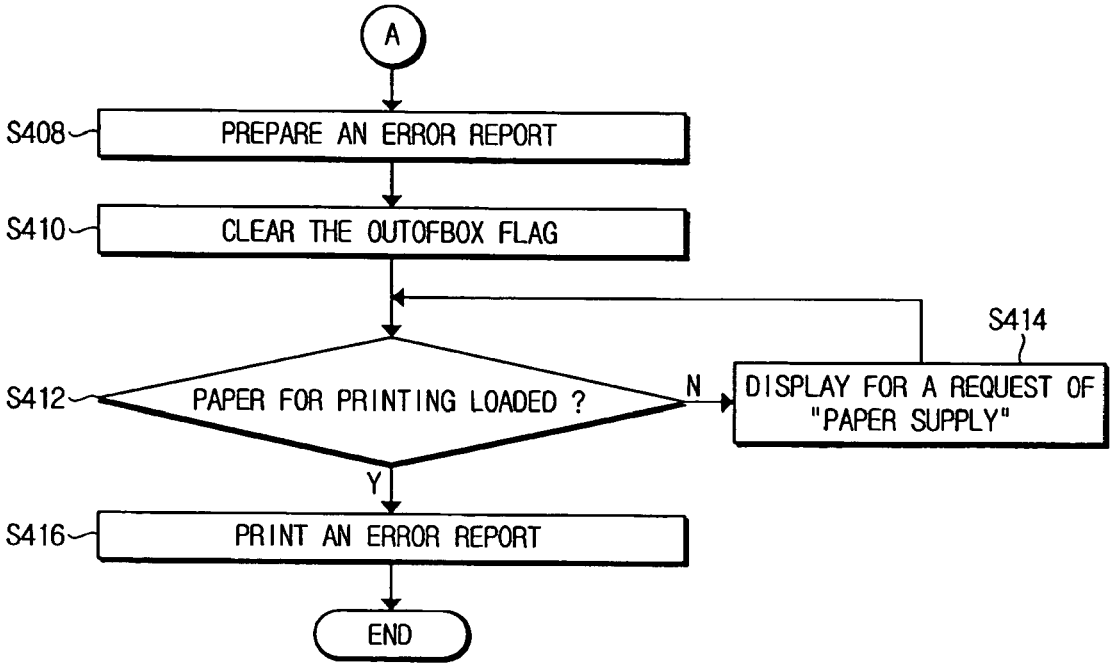

FIG. 4 and FIG. 5 are flow charts illustrating the automatic self-test reporting operations of the image-forming apparatus of FIG. 2, according to an embodiment of the present general inventive concept. Hereinafter, a description will be made on the automatic self-test reporting operations of the image-forming apparatus 200 with reference to FIGS. 2 through 5, according to an embodiment of the present general inventive concept.

If electric power is supplied to the image-forming apparatus 200 and the image-forming apparatus 200 is powered on (operation S402), the self-test unit 218 first tests the ROM 202, RAM 204, various kinds of lamps (not shown), printer engine (not shown) of the print unit 216, scan motor (not shown), recording medium 208, and others, of the image-forming apparatus 200. If errors are determined to exist as a result of the test of the corresponding devices or components, the self-test unit 218 stores the error information in the RAM 204. The self-test unit 218 continues the test until all predetermined test items are completely checked (operation S404).

When the self test is terminated, the control unit 220 reads out the OutofBox flag stored in the ROM 202, and checks if the Outofbox flag is set. The OutofBox flag is set by the manufacturer, and, if a user purchases and turns on the image-forming apparatus 200 for the first time, the OutofBox flag has been set (operation S406).

If the OutofBox flag is already determined to have been cleared and not set as a result of the check at the operation S406, the self-test unit 218 decides that the image-forming apparatus 200 is not powered on for the first time, and does not proceed with a routine A or prepare any result report. Further, the control unit 220 keeps the OutofBox flag cleared instead of setting the flag again.

Hereinafter, a description will be made with reference to FIG. 5.

If the OutofBox flag is set, the control unit 220 prepares a result report. The result report is prepared regardless of a result of the self test. Thus, the result report is prepared even in case of normal operations when no error has occurred. The result report can include countermeasures to the errors, system information, user's setting options, and so on, in addition to the self-test result, and, to do so, the self-test unit 218 reads corresponding information out of the ROM 202. The control unit 220 stores the result report in the RAM 204, and converts the report into a format in which the print unit 216 can deal with. Further, the self-test unit 218 delivers the converted result report to the print unit 216 (operation S408).

The control unit 220 clears and stores the OutofBox flag in the ROM 202 after the converted result report is delivered to the print unit 216. If the user turns off the power without supplying paper before printing the result report so prepared, the control unit 220 causes the result report to be prepared again without the report printed (operation S410).

The control unit 220 decides whether paper is supplied (operation S412), and, if the paper is not supplied, the control unit 220 causes the display unit 212 to display the information requesting for paper supply (operation S414).

The print unit 216 prints on paper images corresponding to the result report delivered from the control unit 220 (operation S416).

Hereinafter, description will be made with respect to the automatic self-test reporting operations of an image-forming apparatus according to another embodiment of the present general inventive concept.

Figure 6:
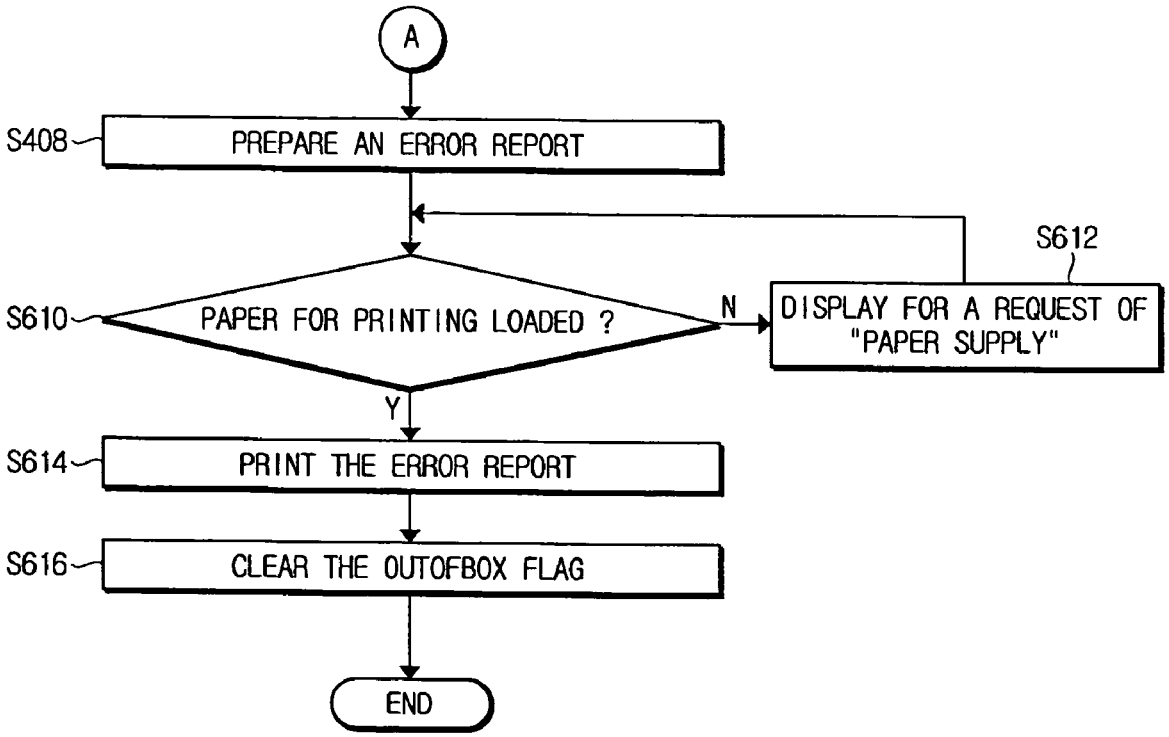

FIG. 4 and FIG. 6 are flow charts illustrating automatic self-test reporting operations of an image-forming apparatus according to another embodiment of the present general inventive concept.

In a routine A of FIG. 6, operation S608 of FIG. 6 corresponds to the operation S408 of FIG. 5, and the same description can be applied to operations S610 to S614 of FIG. 6 which correspond to the operations S412 to S416 of FIG. 5.

However, the embodiment FIG. 6 has an operation S616, which corresponds to the operation S410 of FIG. 5. The control unit 220 causes the print unit 216 to print the result report on paper, and clears and stores the OutofBox flag (operation S616).

By doing so, even in a case that a user turns off the image-forming apparatus before the result report prepared is printed on paper, the OutofBox flag is maintained rather than cleared so that the result report can be prepared and printed when the image-forming apparatus is turned on again.

Further, according to another embodiment of the present general inventive concept, a manager can set the OutofBox flag again in a management mode enabling the manager to change the setting options of the image-forming apparatus.

Through the process as stated above, the automatic self-test reporting can be performed by the image-forming apparatus of FIG. 2.

As described above, the embodiment of the present general inventive concept can provide precise and detailed information on errors, if a user purchases and turns on the image-forming apparatus for the first time and the errors occur as a result of the self test. Thus, the user can obtain precise information on the errors so as to easily solve the errors. The present general inventive concept outputs information of "normal" even in a case that there is no error, so the user can have the belief that the purchased product works in a normal manner. Further, such a process can be done without controls from a the host, and a user does not have to perform extra manipulations in order to obtain the initial setting options of the purchased image-forming apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image-forming apparatus having an automatic self-test reporting function, comprising:

a memory to store reference information on whether electric power is applied for the first time;

a self-test unit to perform self test when powered on; and a control unit to compare a result of the self test with the stored reference information to determine whether the power is applied for the first time, and to cause a result report to be produced according to the result of the self test if the power is applied for the first time.

2. The image-forming apparatus as claimed in claim 1, further comprising a print unit to print the result report.

3. The image-forming apparatus as claimed in claim 1, wherein the reference information is in a form of a flag, and indicates a first power-on if the reference information is set.

4. The image-forming apparatus as claimed in claim 3, wherein the reference information is cleared after a first reference by the control unit to the reference information.

5. The image-forming apparatus as claimed in claim 1, wherein the result report includes at least one item of errors which have occurred in the result of the self test, countermeasures to information on the errors, system information and setting options of the image-forming apparatus.

6. The image-forming apparatus as claimed in claim 1, wherein the user is requested to supply paper to print if there is no paper to print the result report.

7. An automatic self-test reporting method of an image-forming apparatus, comprising:

storing reference information on whether electric power is applied for the first time;

performing a self test when powered on and storing a result of the self test; and reading out the reference information and, if determined to be a first power-on, preparing a result report according to the result of the self test.

8. The automatic self-test reporting method as claimed in claim 7, further comprising printing images corresponding to the result report on an image recording medium.

9. The automatic self-test reporting method as claimed in claim 7, wherein the reference information is in a form of a flag and indicates the first power-on if the reference information is set.

10. The automatic self-test reporting method as claimed in claim 9, wherein the reference information is cleared after a first reference to the reference information.

11. The automatic self-test reporting method as claimed in claim 7, wherein the result report includes at least one item of errors which have occurred in the result of the self test, countermeasures to information on the errors, system information and setting options of the image-forming apparatus.

12. The automatic self-test reporting method as claimed in claim 7, wherein the printing operation displays information requesting a user to supply paper to print, if there is no paper to print the result report.

13. An image-forming apparatus having an automatic self-test reporting function, comprising:

a memory to store reference information on whether power is being applied for the first time; and a central processing unit to perform a self test when powered on and to compare a result of the self test with the stored reference information to decide whether the power is being applied for the first time, and to cause a result report to be produced according to the result of the self test if it is determined that power is being applied for the first time.

14. The image-forming apparatus as claimed in claim 13, wherein the central processing unit comprises:

a testing portion to perform the self-test; and a control portion to perform the comparison and to cause the result report to be produced.

15. The image-forming apparatus as claimed in claim 13, wherein after the result report is produced, the central processing unit clears predetermined information in the memory associated with the reference information.

16. An automatic self-test reporting method of an image forming apparatus, comprising:

performing a self test when power is turned on and storing the result of the self test in a first memory; and comparing the stored results of the self test with predetermined information stored in a second memory, and if a predetermined comparison result is determined, preparing a result report according to the result of the self test.

17. The automatic self-test reporting method as claimed in claim 16, wherein the predetermined information stored in the second memory includes a flag which indicates that power is turned on for the first time.

18. The automatic self-test reporting method as claimed in claim 17, wherein the flag is cleared after the predetermined comparison result is determined.

19. The automatic self-test reporting method as claimed in claim 7, wherein the result report includes at least one item of errors which have been determined to occur in the result of the self test, countermeasures to information on the errors, system information and setting options of the image-forming apparatus.

20. A computer readable storage medium containing an automatic self-test reporting method of an image forming apparatus, the method comprising:

storing reference information on whether electric power is applied for the first time;

performing a self test when powered on and storing a result of the self test; and reading out the reference information and, if determined to be a first power-on, preparing a result report according to the result of the self test.

* * * * *